US011022005B2

(12) United States Patent
Levin

(10) Patent No.: US 11,022,005 B2
(45) Date of Patent: Jun. 1, 2021

(54) STEAM TURBINE POWER PLANT UTILIZING INDUSTRIAL HEAT PUMPS TO PREHEAT BOILER FEED-WATER

(71) Applicant: Joel Melvin Levin, Wynnewood, PA (US)

(72) Inventor: Joel Melvin Levin, Wynnewood, PA (US)

( * ) Notice: Subject to any disclaimer, the term of this patent is extended or adjusted under 35 U.S.C. 154(b) by 4 days.

(21) Appl. No.: 16/948,483

(22) Filed: Sep. 21, 2020

(65) Prior Publication Data

US 2021/0025292 A1 Jan. 28, 2021

Related U.S. Application Data

(60) Provisional application No. 62/876,863, filed on Jul. 22, 2019.

(51) Int. Cl.

| | |
|---|---|
| ***F01K 9/00*** | (2006.01) |
| ***F01K 17/02*** | (2006.01) |
| ***F01K 7/16*** | (2006.01) |
| ***F01K 17/04*** | (2006.01) |
| ***F22D 1/20*** | (2006.01) |
| ***F22D 11/00*** | (2006.01) |
| ***F22D 1/00*** | (2006.01) |

(52) U.S. Cl.

CPC ..... *F01K 9/003* (2013.01); *F01K 7/16* (2013.01); *F01K 17/02* (2013.01); *F01K 17/04* (2013.01); *F22D 1/003* (2013.01); *F22D 1/20* (2013.01); *F22D 11/00* (2013.01)

(58) Field of Classification Search

CPC . F01K 9/003; F01K 17/04; F01K 7/16; F01K 17/02; F22D 11/00; F22D 1/20; F22D 1/003

USPC ..... 60/653, 654, 670, 677–680

See application file for complete search history.

(56) References Cited

U.S. PATENT DOCUMENTS

| | | | | |
|---|---|---|---|---|
| 2,802,114 A * | 8/1957 | Artsay | F01K 7/32 | 290/2 |
| 4,185,465 A * | 1/1980 | Shaw | F01C 20/125 | 60/678 |
| 4,660,511 A * | 4/1987 | Anderson | F01K 23/04 | 122/1 C |
| 2006/0130482 A1* | 6/2006 | Chino | F01K 17/005 | 60/670 |

(Continued)

*Primary Examiner* — Hoang M Nguyen

(74) *Attorney, Agent, or Firm* — Dunlap Bennett & Ludwig, PLLC; Brendan E. Squire

(57) ABSTRACT

A steam turbine power plant utilizing high temperature high efficiency industrial heat pumps (IHP) to preheat boiler feedwater is disclosed. The typical extraction steam feedwater preheater is replaced by a plurality of series connected heat pumps that produce boiler feedwater by preheating pressurized condensate from a feedwater pump attached to a condensate receiver. A stack economizer extracts waste heat from boiler flue gas to provide a closed loop of hot source water to the heat pumps. The Heat Rate of the power plant will be reduced by approximately 7%. By using leaving condenser water as source water for the lower temperature stage heat pumps, some of the liberated high temperature source water can be diverted to a new boiler combustion air preheater. The combination of feedwater preheating heat pumps plus a boiler combustion air preheater will reduce the Heat Rate of the power plant by approximately 12%.

10 Claims, 3 Drawing Sheets

(56) References Cited

U.S. PATENT DOCUMENTS

| | | | | |
|---|---|---|---|---|
| 2011/0113786 | A1* | 5/2011 | Rancruel | F01K 25/08 60/772 |
| 2015/0369084 | A1* | 12/2015 | Levin | F01K 9/003 60/676 |

* cited by examiner

STEAM TURBINE POWER PLANT UTILIZING INDUSTRIAL HEAT PUMPS TO PREHEAT BOILER FEED-WATER

CROSS-REFERENCE TO RELATED APPLICATION

This application claims the benefit of priority of U.S. provisional application No. 62/876,863 filed Jul. 22, 2019, the contents of which are herein incorporated by reference.

BACKGROUND OF THE INVENTION

The present invention relates to a steam turbine power plant utilizing industrial heat pumps to preheat boiler feed-water.

In steam turbine power plants, fuel costs are a major cost of doing business and the carbon emissions from fossil fuel combustion create severe environmental problems. Steam turbine power plants typically preheat boiler feed-water using extraction steam from the turbines.

Steam turbine power plants presently use boilers operating with nominal efficiencies in the range of 80% to burn fossil fuel to provide heat to preheat boiler feed-water. Purchasing the required fuel is a major operating expense, and the carbon emissions resulting from fuel combustion are damaging to the environment.

The existing systems work, but the present consumption and cost of purchasing fuel is a major operating expense and the associated carbon emissions are damaging to the environment.

As can be seen, there is a need for a system and method to substantially reduce fuel consumption, fuel cost and carbon emissions of steam turbine power plants.

SUMMARY OF THE INVENTION

In one aspect of the present invention, a steam turbine power plant is disclosed. The steam turbine power plant includes a boiler receiving feedwater at a desired feedwater temperature and pressure. The boiler is configured to heat the incoming feedwater. to produce high pressure supersaturated steam. The boiler also has a stack to discharge hot flue gas to atmosphere. One or more steam turbines are driven by the high pressure steam and discharge a portion of the steam as a low-pressure steam. A condenser is configured to use cool water from a cooling tower or a nearby stream to lower the condensing temperature and pressure of the steam leaving the turbine as it condenses into condensate. A condenser water pump circulates the warm condenser water leaving the condenser to a cooling tower where the warm condenser water is cooled before being fed to the condenser. A condensate receiver tank is configured to contain the condensate that is discharged from the condenser. At least one feedwater pump is configured to extract the condensate from the condensate receiver, pressurize the condensate and deliver the pressurized condensate as boiler feedwater to the boiler feedwater inlet. A stack economizer is operably coupled to the stack. The stack economizer is coupled to a closed loop heat pump source water circuit and is configured to heat the source water to a selected temperature by extracting some of the waste heat from the flue gas emitted through the stack by means of a heat exchanger. A loop pump is provided to circulate the heat pump source water through the closed loop heat pump source water circuit. A plurality of industrial heat pumps is arrayed in a cascaded series. The plurality of industrial heat pumps define a feedwater preheat circuit between a first stage industrial heat pump and a final stage industrial heat pump of the plurality of industrial heat pumps. A heat pump source water pump circulates the heat pump source water from the stack economizer to the final stage industrial heat pump and then to each lower temperature stage industrial heat pump of the plurality of industrial heat pumps and then returns the cooled source water to the stack economizer. The heat pumps extract heat from the source water, raise the temperature of the extracted heat, and transfer the high temperature heat to the condensate in the feedwater circuit to elevate the condensate temperature to the desired feedwater temperature and deliver the preheated condensate to the boiler as feedwater.

In some embodiments each of the plurality of industrial heat pumps has a coefficient of performance (COP) greater than 6 and a lift of at most 45 Deg. F.

In some embodiments, the plurality of industrial heat pumps further comprises at least one intermediate stage industrial heat pump.

In some embodiments, a boiler combustion air preheater is configured to receive some of the hot source water from the stack economizer and exchange a portion of the thermal energy from the source water with the incoming boiler combustion air in order to preheat the boiler combustion air, thereby increasing the combustion efficiency of the boiler.

In some embodiments, at least one feedwater pump extracts condensate from the condensate receiver, pressurizes the condensate and drives the pressurized condensate through the plurality of industrial heat pumps and delivers the pressurized and preheated feedwater to the feedwater inlet of the steam boiler.

In some embodiments, a second feedwater pump may additionally pressurize the feedwater leaving the final stage industrial heat pump prior to delivering the feedwater to the feedwater inlet of the boiler.

In some embodiments, at least one intermediate stage industrial heat pump is connected in series with at least one of the first stage industrial heat pumps and the final stage industrial heat pump.

In other embodiments, some of the warm leaving condenser water from the cooling tower pump is diverted to serve as source water for the lower temperature heat pumps. Feedwater pumps drive condensate from the condensate receiver tank to the lower temperature industrial heat pumps where the heat pumps extract heat from the source water to heat the condensate to a designated intermediate temperature. The cooled source water from the lower temperature heat pumps is returned to the leaving condenser water stream that is being sent to the cooling tower. The partially preheated condenser water from the lower temperature heat pumps is fed to the high temperature heat pumps that utilize the hot heat pump source water from the stack economizer as source water to heat the condensate to the desired boiler feedwater temperature.

In yet other embodiments, at least one intermediate industrial heat pump is connected in series between the first stage industrial heat pump and the final stage industrial heat pump.

These and other features, aspects and advantages of the present invention will become better understood with reference to the following drawings, description and claims.

DETAILED DESCRIPTION OF THE INVENTION

The following detailed description is of the best currently contemplated modes of carrying out exemplary embodiments of the invention. The description is not to be taken in a limiting sense, but is made merely for the purpose of illustrating the general principles of the invention, since the scope of the invention is best defined by the appended claims.

In a steam turbine power plant, the present invention reduces both the amount of fuel consumed per exported kWh (heat rate) and its associated carbon emissions by more than 7%. This dramatic reduction is achieved by using appropriately configured new state-of-the-art high efficiency industrial heat pumps (IHPs) to preheat the boiler feedwater to 300° F. instead of using boilers with a nominal efficiency of 80% for this purpose. Applied in conjunction with the complementary technology of combustion air preheat, the heat rate and carbon emissions from a steam turbine power plant can be reduced by more than 12%.

The present invention replaces boiler heat for preheating feedwater with a system of "state-of-the-art" industrial heat pumps to preheat boiler feed-water with an efficiency of 700% (Coefficient of Performance (COP) of 7). Using industrial heat pumps to preheat boiler feedwater to a temperature of 300° F. with an efficiency of 700% is a new application of high performance industrial heat pump technology.

Historically, industrial heat pumps could operate with a COP of 4 to raise the temperature of a target load to 180° F., but the benefits were relatively small. Recent advances in industrial heat pump technology have reached a level where the industrial heat pumps can now heat a target load to 300° F. with a COP of 7 if they are properly configured.

This recent extraordinary performance improvement in heat pump technology makes it feasible and cost-effective to replace the present system of preheating boiler feedwater with a plurality of series-connected industrial heat pumps. The heat source for the industrial heat pumps is waste heat that is recovered from flue gas and/or from the warm turbine condenser water. The present invention reduces the fuel consumption, fuel cost and carbon emissions of the entire plant by more than 6%. When used in conjunction with combustion air preheat, the present fuel consumption and carbon emissions from a steam turbine power plant can be reduced from present levels by more than 12%.

Figure 1:
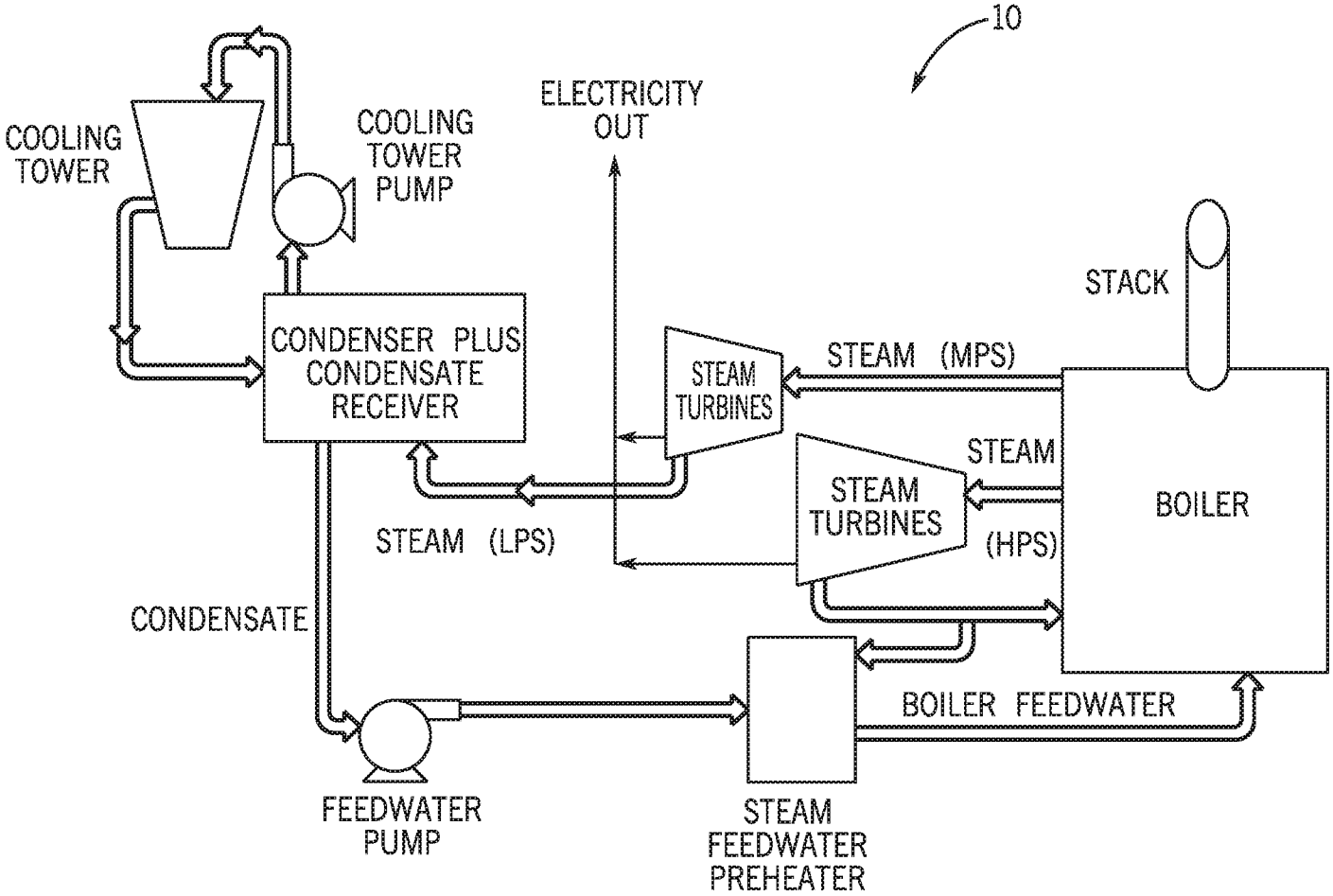
FIG. 1 is a schematic diagram of a basic steam turbine power plant.

Referring now to the FIG. 1, a conventional Rankine Cycle steam power plant is shown. A boiler, receiving a source of preheated and pressurized feedwater, heats the feedwater to produce high pressure steam. The boiler typically relies on a heat source produced by the combustion of fossil fuels to preheat the feed water and to produce the high-pressure steam. The combustion byproducts are carried from the boiler via a stack.

The high-pressure steam is introduced to one or more steam turbines, driving the high-pressure steam turbines to produce electricity. Some partially spent steam (extraction steam) can be extracted from the turbine at an intermediate pressure and diverted to a feedwater preheater that uses the extracted steam to preheat the feedwater from the condensate receiver tank. The remaining partially spent steam may be directed back to the boiler, reheated, and introduced to a medium pressure steam turbine to generate more electricity.

Medium pressure steam (MPS) enters a second steam turbine to generate more electricity and is then discharged as low-pressure steam (LPS) and may be directed back to a condenser, which may be equipped with a condensate receiver. The LPS is passed through a condenser to return the LPS to a liquid state (condensate) which is then collected in a condensate receiver. The condensate may then be circulated back to the feedwater preheater via a feedwater pump.

Figure 2:
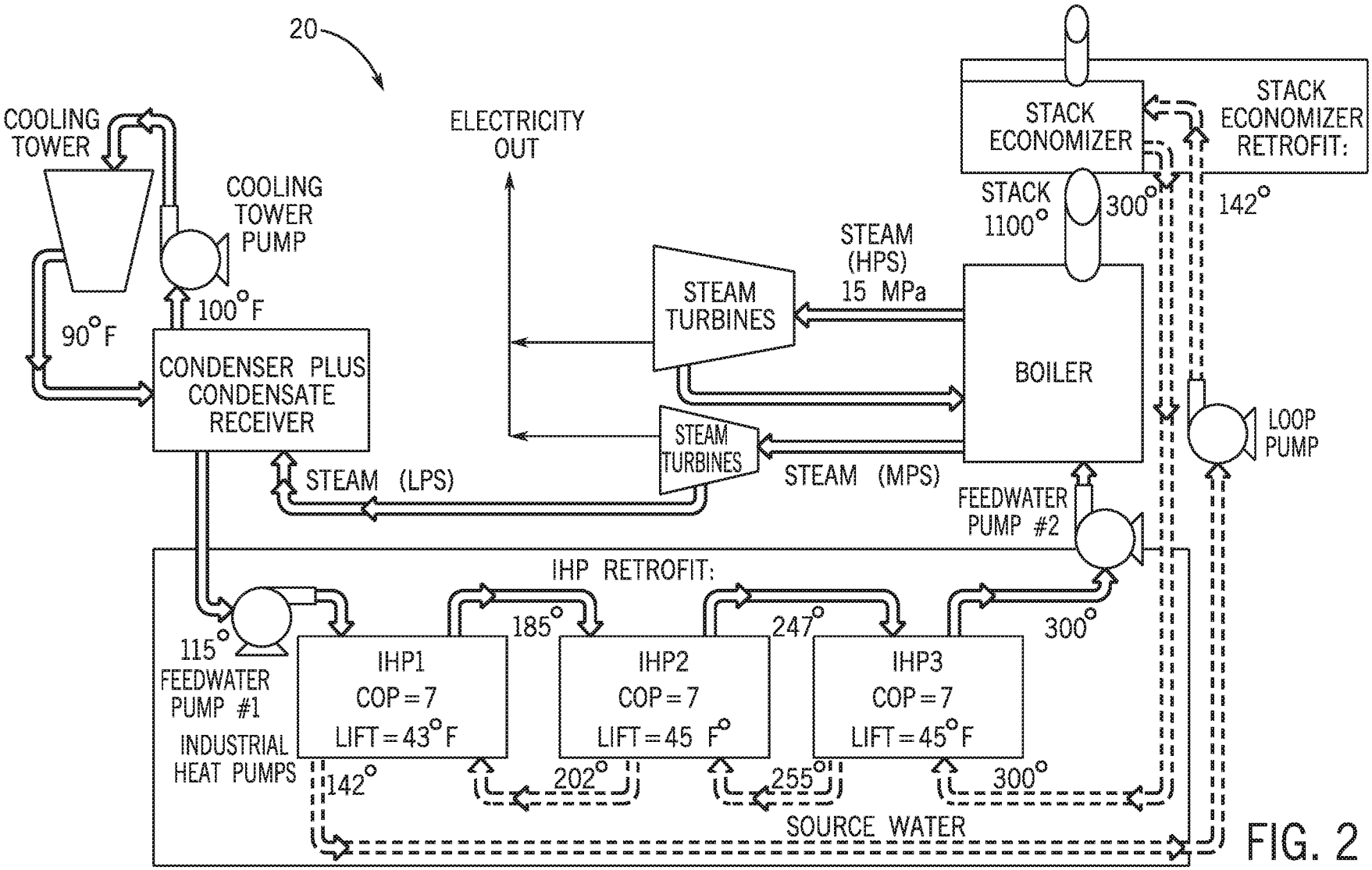
FIG. 2 is a schematic diagram of a modified steam turbine power plant according to aspects of the present invention.

As seen in reference to FIG. 2, in the present invention, a plurality of industrial heat pumps IHP1, IHP 2, and IHP3, each sized to satisfy a feed-water preheat load of the power plant are provided and arrayed in a series connection in a feedwater circuit and a source water circuit. In a preferred embodiment, each of the plurality of IHPs have the capability of operating with a COP greater than 6 and a lift of 45 Deg. F or less. The plurality of IHPs are installed in series in the boiler feed-water line, between the boiler feed-water pump and the boiler and are configured to elevate the temperature of the condensate from about 115 Deg. F to approximately 300 Deg. F The heat pumps extract heat from the source water circuit to preheat the condensate in the feedwater circuit.

A second feedwater pump, when installed, is located between the plurality of industrial heat pumps and the boiler. The second feedwater pump further pressurizes the heated feedwater leaving the final stage industrial heat pump and discharges it into the steam boiler where it is heated and converted into supersaturated steam. The pressurized supersaturated steam from the boiler is released into one or more steam turbines to generate electricity. The spent low pressure steam leaves the turbine and enters a condenser where it is cooled by circulating cool condenser water from a cooling tower and condensed to a low pressure condensate. The low pressure condensate is collected by a condensate receiver tank.

A feed-water pump raises the pressure of the condensate from the condensate receiver tank and sends the pressurized condensate to the plurality of industrial heat pumps to be preheated for boiler feedwater.

A boiler stack economizer (heat exchanger) is installed between the boiler and the stack to extract waste heat from the hot boiler flue gas and transfer the waste heat to a closed loop source water circuit supplying the source water at 300° F. to the industrial heat pumps. A loop pump circulates the 300° F. source water heated by the boiler stack economizer through the closed loop to provide source water to the industrial heat pumps.

Figure 3:
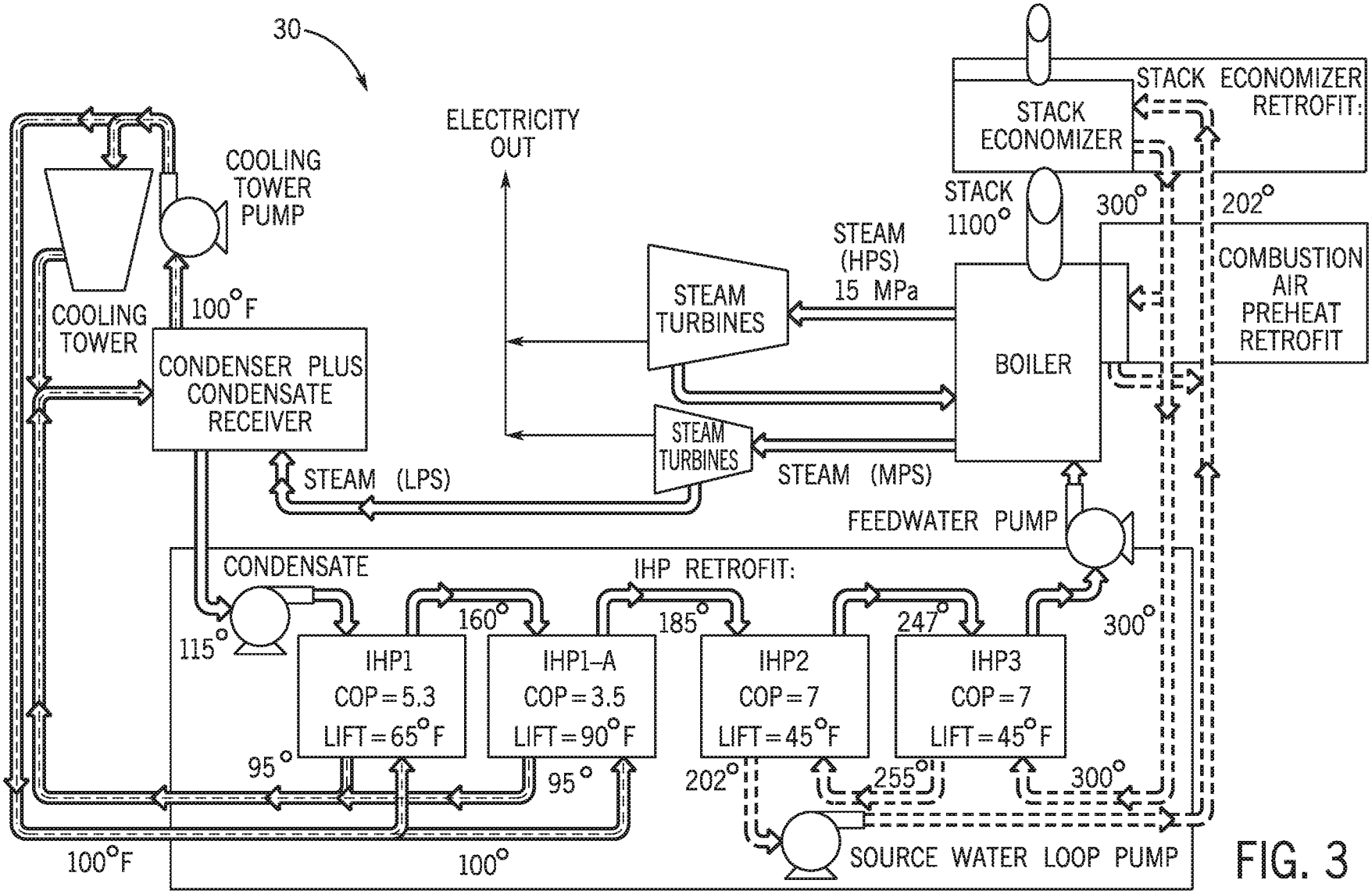
FIG. 3 is a schematic diagram of a steam turbine power plant with enhancements according to further aspects of the present invention.

In the embodiment shown in reference to FIG. 3, a combustion air preheat coil and assembly may be added to the boiler to supplement the basic industrial heat pump configuration. This optional addition utilizes a portion of the source water discharged from the stack economizer to preheat the ambient, incoming combustion air to increase the combustion efficiency of the boiler.

As will be appreciated from the present disclosure, the basic Rankine Cycle steam power plant is modified by installing an industrial heat pump retrofit. The industrial heat pump retrofit includes a plurality of cascaded state-of-the-art high-performance industrial heat pump stages that are provided in the boiler feed-water line downstream from the condensate receiver tank and feed-water pump and upstream from the boiler.

In the embodiment shown in FIG. 2, the plurality of IHP stages are selected so that a lift, representing the temperature differential between the output temperature of a source water circuit and the output temperature of a feed water circuit, at each IHP stage is less than 45 Degrees F. to assure that the COP of each heat pump is greater than 6. The industrial heat pumps are installed in the existing boiler feed-water line in a cascaded series configuration. If there is an existing feed-water preheater, it is replaced by the staged industrial heat pumps, as an IHP retrofit.

A first feed-water pump #1 extracts steam turbine condensate from the turbine condensate receiver tank, typically at a temperature of 115° F., pressurizes the condensate as a feedwater source for the feedwater circuit, which is then circulated through the plurality of heat pumps connected in series.

Source water is provided to the source water circuit to the plurality of industrial heat pumps within a closed loop circuit. The source water is heated by a boiler stack economizer to provide the source water at a temperature of approximately 300 Degrees F. to the final stage IHP that provides the hottest feedwater to the feedwater pump #2 and the boiler. A loop pump circulates the source water from the boiler stack economizer to the final stage IHP in the series-connected cascaded heat pump stages and then circulates the source water back to the stack economizer to be reheated.

The temperature of the returning source water from the cascaded heat pumps is typically on the order of 142° F. The heat recovered by the stack economizer from the flue gas is used to raise the temperature of the returning source water from 142° F. to 300° F. before circulating the source water back to the final stage IHP.

Cascade configuration means that the discharged cooled source water from a subsequent higher temperature heat pump stage is used as the intake source water for a preceding lower temperature heat pump stage. In the embodiment shown, source water entering the final stage industrial heat pump IHP at 300° F. is cooled at each stage until it is discharged from the first industrial heat pump stage, IHP1, at approximately 142° F.

Each of the cascaded heat pumps elevates the temperature of its incoming feedwater and discharges its heated feedwater as an input to the subsequent industrial heat pump to raise the feedwater temperature to the desired input temperature for the boiler. In the embodiment shown, the plurality of heat pumps preheats the incoming condensate from a condensate receiver temperature (approximately 115° F.) to 300° F. feedwater.

In the non-limiting embodiment shown, since the "lift" of each industrial heat pump is less than 45° F., each heat pump operates with a COP of approximately 7. Consequently, since each industrial heat pump operates with a COP of 7, the entire process of heating the feed-water from 115° F. to 300° F. occurs with a COP of 7 (700% efficiency). Since this heat is normally provided by a boiler operating at a nominal efficiency of 80%, the input energy required to preheat the feed-water is reduced by 88% (1-80%/700%).

In the non-limiting embodiment show in FIG. 2, the three industrial heat pumps were required, the lowest temperature heat pump would heat the pressurized condensate from 115° F. to 185° F. The next heat pump would raise the temperature from 185° F. to 247° F., and the third heat pump would raise the temperature of the feed-water from 247° F. to 300° F. Source water enters the highest temperature heat pump at 300° F. and leave it at 255° F. The leaving 255° F. source water from the highest temperature heat pump enters the middle temperature heat pump and leaves at a temperature of 202° F. The leaving 202° F. source water from the middle temperature heat pump enters the lowest temperature heat pump and leaves at a temperature of 142° F. Since each industrial heat pump operates with a COP of 7, the entire process of heating the feed-water from 115° F. to 300° F. occurs with a COP of 7 (700% efficiency).

A second feedwater pump further pressurizes the preheated feed-water leaving the heat pump array and introduce it into the steam boiler where it is heated and converted into supersaturated steam. The pressurized supersaturated steam from the boiler is released into an array of one or more steam turbines to generate electricity. The spent steam leaves the turbine and enters a condenser where it is cooled and condensed to a low pressure condensate which is collected by a condensate receiver tank.

Installing industrial heat pumps to replace the existing feed-water heater that uses extracted steam to preheat the feedwater impacts the steam plant's heat rate in three ways: 1) Because of the vastly improved efficiency of the industrial heat pumps and their use of recovered waste heat, less fossil fuel is required to preheat the feedwater and therefore less fossil fuel is required to generate high pressure steam from condensate; 2) The need for extraction steam is reduced or eliminated so less of the generated boiler steam is diverted from the turbines and instead the steam which had been diverted now passes through all the turbines, thereby increasing the electricity output of the turbines from each pound of generated steam; 3) The industrial heat pumps use electricity, and this introduces a parasitic load that partially offsets the other two benefits, but because the COP of the heat pumps is so high, this parasitic load is small. The net effect of these changes is to reduce the heat rate substantially. Analysis of the heat rate of a two-turbine plant with a heat rate of 9,461 BTUS per kWh disclosed that installing industrial heat pumps to preheat boiler feedwater reduces the existing heat rate of 9,461 BTUs per kWh to 8,755 BTUs per kWh. This represents a heat rate reduction of 7.5%.

The IHP retrofit of the present invention replaces a relatively inefficient boiler system for preheating boiler feedwater in a steam turbine power plant with a highly efficient industrial heat pump system to efficiently preheat the boiler feedwater. The new system optimizes the performance of this new cutting-edge industrial heat pump technology by utilizing a boiler stack economizer to recover waste heat from the flue gas and then using this waste heat to generate high temperature source water to enable the industrial heat pumps to operate near their maximum rated efficiencies (COP greater than 6).

This combination reduces the input energy required to preheat boiler feedwater by 88%. By eliminating the fuel required to preheat the boiler feedwater, less fuel is required to produce a given amount of steam. Furthermore, the present invention eliminates the need to use extraction steam that is presently diverted from the turbines to preheat the boiler feedwater and returns the diverted steam back to the turbines to generate more electricity. Thus, for a given amount of steam production, the present invention lowers the fuel consumption of the plant and increases the steam flow through the turbines, thereby increasing the amount of electricity generated by the plant. Even after subtracting the parasitic loads of the industrial heat pumps from the total power generated, the heat rate of the plant is reduced by more than 7%. The remaining power plant operations are unchanged.

In the embodiment of the present invention shown in reference to FIG. 3, which is also a redesign of a traditional Rankine Cycle steam turbine power plant, enhanced performance characteristics enable steam turbine power plants to operate much more efficiently. First the maximum boiler feedwater flow of the power plant is determined. Then the feedwater preheat load, the amount of heat that is required to raise the temperature of this feedwater to a desired boiler input temperature, typically 300° F., is determined. In this embodiment, each industrial heat pump is capable of operating with a COP greater than 6 if the lift is less than 55° F. The lift is defined as the temperature difference between the leaving heated water (the "sink") and the leaving cooled source water.

In this embodiment, a boiler stack economizer is also installed between the boiler and the stack. The stack economizer is selected with a heating output capacity that is at least 90% of the feedwater preheating load. A closed pipe loop with a variable speed source water loop pump is installed to circulate heated source water through a plurality of cascaded industrial heat pumps and then through the stack economizer. The stack economizer is capable of heating incoming 142° F. source water to an outgoing temperature of 300° F. The source water loop pump is selected to maintain an operating pressure that prevents the hot circulating source water from vaporizing.

If there is an existing steam feedwater preheater with extraction steam connections, this equipment is removed (or bypassed). The industrial heat pumps are installed in series in a cascaded configuration in the existing boiler feedwater line downstream from the condensate receiver tank and first feedwater pump and upstream from the boiler and second feedwater pump. Cascade configuration means that the leaving cooled source water from the higher temperature heat pump is used as entering source water for the preceding lower temperature heat pump. Source water entering the final heat pump stage at 300° F. is cooled at each preceding stage until it leaves the lowest temperature cascaded heat pump at approximately 142° F.

The feedwater pump draws the condensate from the sub-barometric pressure condensate receiver tank and raises its pressure to a level that assures that it does not vaporize when it is heated to its final feedwater temperature (300° F.). The feedwater pump discharges the pressurized condensate into the lowest temperature heat pump. The temperature of the condensate/feedwater is raised successively by each of the series-connected heat pumps until it emerges as boiler feedwater with a temperature of 300° F. A second feedwater pump may be used to raise the pressure of the preheated feedwater leaving the hottest heat pump to the desired boiler inlet pressure. Appropriate temperature and flow controls are installed to assure that the flow and temperature of both the feedwater and source water are synchronized and appropriate to interface with the varying load conditions of the power plant.

The dramatically lower heat rate resulting from the present invention allows the generating plant to either maintain the same electric output while reducing its fuel consumption and emissions or to increase its electric output and revenue while maintaining its present fuel consumption. If the plant wishes to utilize the reduced heat rate to allow it to increase its electric output, the capacity of its electric generators and distribution system may require upgrades to accommodate the increased output.

As seen in reference to FIG. 3, the present invention may be significantly improved by installing a combustion air preheater in the boiler and using some of the source water generated by the stack economizer to provide hot water to the combustion air preheat coils. However, the amount of heat that can be extracted from the flue gas is limited. The extraction of waste heat from the flue gas lowers its temperature, and there are lower limits on the cooled flue gas temperature that must be maintained in order to prevent corrosion of the boiler system if moisture in the flue gas were to condense at the lower temperatures and combine with impurities in the flue gas to form corrosive acids. These temperature limits are not breached by the industrial heat pump invention described above, but extracting more heat from the flue gas and using it to preheat combustion air could breach these limits. Accordingly, operating parameters of the plant should be monitored and controlled.

In order to assure that there is sufficient heat available to heat both source water and combustion air, the extraordinary performance characteristics of industrial heat pumps can be applied to allow waste heat from the warm condenser water to be used as the source heat for the lower temperature stages of the IHP retrofit for feedwater preheating. Extraction of additional heat from the leaving condenser water in the condenser water circulation circuit can be used to reduce the amount of hot source water from the stack economizer presently required by the heat pump array of FIG. 2, thereby freeing some of the heat from the stack economizer to be diverted to the combustion air preheat coils.

This embodiment of the present invention can release sufficient heat to raise the temperature of the boiler combustion air by 200° F., resulting in a boiler efficiency increase of 5%. This benefit is partially offset because the industrial heat pumps using warm condenser water as a heat source have a larger lift, causing a lower COP and therefore increasing the parasitic load of the industrial heat pumps. However, this additional parasitic load pales in comparison to the increased savings achieved by increasing the boiler efficiency by 5%. It should also be noted that recovering heat from the warm condenser water reduces the temperature of the condenser water, thereby reducing the load on the cooling tower fans and reducing the condenser water makeup water requirements.

To optimize the COP of the heat pumps using the condenser water as source water, a first plurality of industrial heat pumps can be arranged in series, each using warm condenser water at 100° F. as source water to raise the temperature of the 115° F. condensate to a temperature of 185° F. In order to minimize the temperature lift, the flow of cooling tower source water through each heat pump is approximately five times the flow of feedwater, thereby reducing the temperature drop of the condenser source water and consequently minimizing the lift of each heat pump.

In the non-limiting embodiment shown, the first heat pump raises the temperature of the 115° F. condensate to 160° F. The lift is 65° F. (160–95) and the COP is 5.3. The second heat pump raises the temperature of the 160° F. feedwater leaving the first heat pump at 160° F. to a temperature of 185° F. The lift is 90° F. (185–95) and the COP is 3.5. The collective performance of these two heat pumps raises the temperature of the condensate feedwater from 115° F. to 185° F. with a net COP of 4.5. The remaining feedwater heating is performed by a pair of cascaded heat pumps that raise the feedwater temperature from 185° F. to 300° F. with a COP of 7 using source water from the stack economizer that enters at 300° F. and is discharged at 202° F. Using condenser water as the heat source for an initial part of the feedwater heating load reduces the amount of heat required from the stack economizer to heat the hot source water loop. Consequently, there is sufficient heat available to divert some of the source loop water to the combustion air preheat coils to increase the boiler efficiency from 80% to 85%.

Preheating the boiler feedwater with industrial heat pumps lowers the boiler output load significantly, and this reduced boiler load can now be satisfied with a boiler operating at a higher efficiency of 85%. The resulting power plant configuration reduces the base power plant heat rate of 9,461 BTUS per kWh to a heat rate of 8,298 BTUS per kWh. This represents a heat rate reduction of 12.3% from the original base power plant. If the plant were to choose to use the enhanced heat rate to increase its exportable electricity production, the plant could increase its exportable electric output and gross revenue by 14% while maintaining its present level of fuel consumption and cost.

Some steam turbine plants export extraction steam to serve external thermal loads but do not recover any or all of the condensate from the exported steam. In such plants large quantities of makeup water are added to the feedwater stream before preheating it. The temperature of the makeup water is nominally in the range of 60° F. which lowers the average temperature of the water entering feedwater preheaters. This makeup water can be heated very efficiently by installing additional industrial heat pumps. The warm 100° F. turbine condenser water absorbs a vast amount of heat as it condenses the turbine steam. By using the warm condenser water as a heat source for the heat pumps, some of the waste heat in the condenser water can be recovered and used to heat the makeup water with a COP of 7. This design reduces the thermal load on the boiler. In addition, the source water is cooled as its heat is extracted by the heat pumps, and this reduces the cooling tower load. The reduced cooling tower load reduces the energy required by the cooling tower fans and also reduces the amount of makeup water required to replace the condenser water lost through evaporation in the cooling tower.

It should be understood, of course, that the foregoing relates to exemplary embodiments of the invention and that modifications may be made without departing from the spirit and scope of the invention as set forth in the following claims.

What is claimed is:

1. A steam turbine power plant, comprising:

a boiler receiving a feedwater at a desired feedwater temperature and pressure, the boiler configured to heat the feedwater to produce a high-pressure steam, the boiler having a boiler stack to discharge a hot flue gas produced by combustion of a fuel in the boiler;

one or more steam turbines driven by the high-pressure steam and discharging a portion of the high-pressure steam as a low-pressure steam;

a condenser configured to capture the low-pressure steam and convert the low-pressure steam to a condensate;

a condensate receiver tank configured to contain the condensate at a prescribed condensate temperature, at least one feedwater pump configured to extract the condensate from the condensate receiver tank and pressurize the condensate;

a stack economizer coupled to the boiler stack, the stack economizer coupled to a closed loop heat pump source water circuit, the stack economizer configured to heat a heat pump source water in the closed loop heat pump source water circuit to a prescribed source water temperature by extracting a portion of a waste heat from the hot flue gas in the boiler stack;

a loop pump to circulate the heat pump source water through the stack economizer and the closed loop heat pump source water circuit; and a plurality of industrial heat pumps arranged in a cascaded series, the plurality of industrial heat pumps defining a feedwater preheat circuit between a first stage industrial heat pump and a final stage industrial heat pump of the plurality of industrial heat pumps to preheat the condensate from the condensate receiver tank and deliver the preheated condensate as the feedwater to the boiler, the plurality of industrial heat pumps connected to the closed loop heat pump source water circuit, extending the closed loop heat pump source water circuit between the final stage industrial heat pump through a first stage industrial heat pump of the plurality of industrial heat pumps, wherein the plurality of industrial heat pumps extract a thermal energy from the heat pump source water, transfer the thermal energy to the feedwater preheat circuit to raise the condensate drawn from the condensate receiver tank from the prescribed condensate temperature to the desired feedwater temperature and delivering the feedwater to the boiler.

2. The steam turbine power plant of claim 1, wherein each of the plurality of industrial heat pumps have a coefficient of performance (COP) greater than 6 and a lift of at most 45 Deg. F.

3. The steam turbine power plant of claim 2, wherein the plurality of industrial heat pumps further comprises at least one intermediate stage industrial heat pump.

4. The steam turbine power plant of claim 1, further comprising:

a boiler combustion air preheater configured to receive a portion of the heat pump source water from the stack economizer and exchange a portion of the thermal energy from the heat pump source water to preheat an incoming combustion air in order to increase a combustion efficiency of the boiler.

5. The steam turbine power plant of claim 1, wherein the at least one feedwater pump further comprises:

a first feedwater pump in communication between the condensate receiver tank and the first stage industrial heat pump.

6. The steam turbine power plant of claim 5, wherein the at least one feedwater pump further comprises:

a second feedwater pump in communication between the final stage industrial heat pump and the boiler.

7. The steam turbine power plant of claim 1, further comprising:

at least one intermediate stage industrial heat pump connected in series with at least one of the first stage industrial heat pump and the final stage industrial heat pump.

8. The steam turbine power plant of claim 1, further comprising:

a cooling tower; and a cooling tower pump configured to circulate a portion of the warm leaving condenser water through the cooling tower and the remaining portion of the warm leaving condenser water as source water to at least the first low temperature stage industrial heat pump, wherein the lower temperature heat pump extracts thermal energy from the remaining portion of the warm condenser water to partially preheat the incoming feedwater from the condensate receiver tank before feeding the partially preheated condensate to the higher temperature heat pumps.

9. The steam turbine power plant of claim 8, further comprising:

a condenser water return line connecting the leaving source water from the first stage industrial heat pump to the primary leaving condenser water line, wherein the cooling tower pump circulates the total combined, lower temperature condenser water flow to the cooling tower.

10. The steam turbine power plant of claim 9, further comprising:

at least one intermediate industrial heat pump connected in series between the first stage industrial heat pump and the final stage industrial heat pump.

* * * * *